US006058576A

United States Patent [19]

Harris

[11] Patent Number: 6,058,576

[45] Date of Patent: May 9, 2000

[54] JEWELRY CLASP

[76] Inventor: Howard Edwin Harris, 703 Watts St., Cherryville, N.C. 28021

[21] Appl. No.: 09/290,619

[22] Filed: Apr. 13, 1999

[51] Int. Cl.[7] ..... A44B 13/00

[52] U.S. Cl. ..... 24/265 EC; 24/590; 24/20 R; 24/588; 24/616

[58] Field of Search ..... 63/3.1; 24/265 EC, 24/265 BC, 307, 316, 326, 167, 588, 590, 597, 701, 702, 616, 662, 663, 664

[56] References Cited

U.S. PATENT DOCUMENTS

| | | | |
|---|---|---|---|
| 869,059 | 10/1907 | Cashmore | 24/702 X |
| 1,840,896 | 1/1932 | Groh . | |
| 3,513,510 | 5/1970 | Copes | 24/20 R |
| 4,236,283 | 12/1980 | Marosy | 24/201 |
| 4,369,552 | 1/1983 | Gottlieb | 24/701 |
| 4,502,192 | 3/1985 | Hess | 24/590 |
| 4,524,495 | 6/1985 | Hess | 24/590 |
| 4,622,726 | 11/1986 | Nakamura | 24/590 |
| 5,367,891 | 11/1994 | Furuyama | 63/29.2 |
| 5,369,854 | 12/1994 | Stephens | 24/590 |
| 5,456,095 | 10/1995 | Tawil | 63/29.1 |
| 5,774,957 | 7/1998 | Kohl et al. | 24/701 |

*Primary Examiner*—James R. Brittain
*Assistant Examiner*—Robert J. Sandy
*Attorney, Agent, or Firm*—J. Michael Martinez de Andino; McGuire, Woods,Battle & Boothe LLP

[57] ABSTRACT

A method and apparatus for connecting two strand ends such as those found on jewelry pieces such as necklaces, chains and bracelets. The method and apparatus involve fastening the two strand ends using a connecting member attached to one strand and a receiving member attached to another strand end, wherein the connecting member may be removably fastened to the receiving member using a predetermined sequence of simple movements and rotations.

23 Claims, 5 Drawing Sheets

JEWELRY CLASP

BACKGROUND OF THE INVENTION

The present invention relates broadly to strand end fasteners. More specifically, the present invention relates to a method and apparatus for securely fastening two strand ends such as may be found on a necklace or bracelet.

Many devices for connecting two strand ends are common in the jewelry industry and elsewhere. Typically, such connecting devices, or clasps, exhibit a design trade-off between complexity and security. Clasp designs having the virtues of simplicity of manufacture and simplicity of use are often less secure than more complicated or harder to use designs. Designs that require complex locking mechanisms involving internal moving parts or springs may be highly secure but are likely to be impractical from a cost point of view. Moreover, jewelry applications often require very small clasps where complex designs would be difficult and costly to manufacture.

There is a need for a simple, secure, economical clasp that may be sized for virtually any application including the connection of small strands as might be found in necklaces, bracelets or other jewelry items and larger items such as belts.

SUMMARY OF THE INVENTION

It is therefore an object of the present invention to provide an improved jewelry clasp for fastening two strand ends wherein the likelihood of inadvertent release is reduced.

It is also an object of the present invention to provide an improved jewelry clasp that is easily manufactured, simple to use and may be scaled to virtually any size.

Another object of the present invention is to provide an improved jewelry clasp for connecting two strand ends wherein a connection is established using a predetermined sequence of simple movements.

Another object of the present invention is to provide an improved method of fastening two strand ends using a key member attached to one strand end and a receiving member attached to another strand end, wherein the key member may be removably fastened to the receiving member using a predetermined sequence of simple movements including rotation.

To these ends, a clasp for releasably mating two strand ends includes a connecting member having a base and an elongate shaft projecting from the base. The elongate shaft has a proximal end and a distal end and defines a shaft axis. The connecting member further includes a key member formed on the shaft, the key member having a predetermined configuration for rotation about the shaft axis.

The clasp also includes a receiving member for receiving and retaining the key member. The receiving member has slots formed therein for receiving a first portion of the key member when the key member is at a first orientation with respect to the receiving member. The slots are also formed for receiving a second portion of the key member when the key member is rotated about the shaft axis to a second orientation with respect to the receiving member.

The receiving member of a clasp according to the present invention is preferably formed as a generally rectangular block having a first surface and a second surface in spaced opposition and a first end wall and a second end wall in spaced opposition. The receiving member also includes a receiving and retaining cavity formed therein. The first surface of the receiving member includes a first slot and the second surface includes a second slot. These slots are both in communication with the receiving and retaining cavity so that the first portion of the key member may be received by the receiving member when in the first orientation and so that the second portion of the key member may be received by the receiving member when the key member is subsequently rotated to the second orientation.

The first slot preferably extends into the first end wall from the first surface and is preferably generally T-shaped. Alternatively, the first slot may be L-shaped. The second slot preferably includes two parallelly oriented straight slots projecting oppositely away from a cross slot oriented generally perpendicular to the straight slots. Both slots are preferably further configured and positioned for the key member to be retracted laterally away from the second end wall after having been received in the retaining cavity through the application of a sequence of predetermined movements. This sequence includes first, partially inserting the key member through the first and second slots, then moving the key member toward the second end wall and rotating the key member 90°, or one quarter turn, about the shaft axis. Rotation about the shaft axis results in the receipt of the end cross-member by the second slot. After rotation, the key member is substantially enclosed within the receiving and retaining cavity. It will be understood by those skilled in the art that there are many possible configurations and relative positions of the slots that could be used to facilitate these movements. It will further be understood that the slot arrangement is determined at least in part according to the configuration of the key member.

The receiving member preferably includes an arrangement for selectively, removably retaining the connecting member in a retracted position after rotation. This retaining arrangement includes at least one tab and preferably more than one tab projecting into the receiving and retaining cavity. The tab or tabs may be formed on an inner cavity wall or by deforming the receiver member or an outer surface thereof resulting in an internal projection within the receiving and retaining cavity. The tab or tabs contact the key member to selectively impede movement of the key member by requiring that an increased force be applied to retract or release the key member.

The key member of a clasp according to the present invention is preferably generally F-shaped and includes a stem, an end cross-member and a central cross-member. The end cross-member and central cross-member of such a key member are preferably disposed so as to be substantially co-planar with the stem and project perpendicularly away from it. Preferably, the end cross-member projects from a free end of the stem and the central cross-member is disposed so as to be substantially collinear with the shaft.

A method for releasably mating two strand ends according to the present invention includes providing a connecting member attached to a first strand end. The connecting member has a base and an elongate shaft projecting from the base, the elongate shaft having a proximal end and a distal end. The connecting member also includes a key member with a predetermined configuration. The method further includes providing a receiving member attached to a second strand end for receiving and retaining the key member. The receiving member is formed as a generally rectangular block having a first surface and a second surface in spaced opposition and a first end wall and a second end wall in spaced opposition. The receiving member also includes a receiving and retaining cavity formed therein. The first surface of the receiving member has a first slot formed therein and the second surface has a second slot formed therein. Both slots are in communication with the receiving and retaining cavity for receiving a first portion of the key member at a first orientation with respect to the receiving member and receiving a second portion of the key member when the key member is rotated to a second orientation with respect to the receiving member.

The method further includes inserting the key member partially through the first and second slots, then moving the key member toward the second end wall and rotating the key member approximately 90° about the shaft axis for receipt of the key member by the receiving member. The method preferably also includes retracting the key member laterally away from the second end wall after the rotation step, thereby substantially enclosing and retaining the key member in the receiving and retaining cavity.

The present invention provides a simple, efficient device for joining the ends of a strand, preferably a jewelry strand. The clasp of the present invention also provides a secure arrangement for joining the ends of a bracelet, watch band, necklace or belt.

DESCRIPTION OF THE PREFERRED EMBODIMENT

Figure 1:
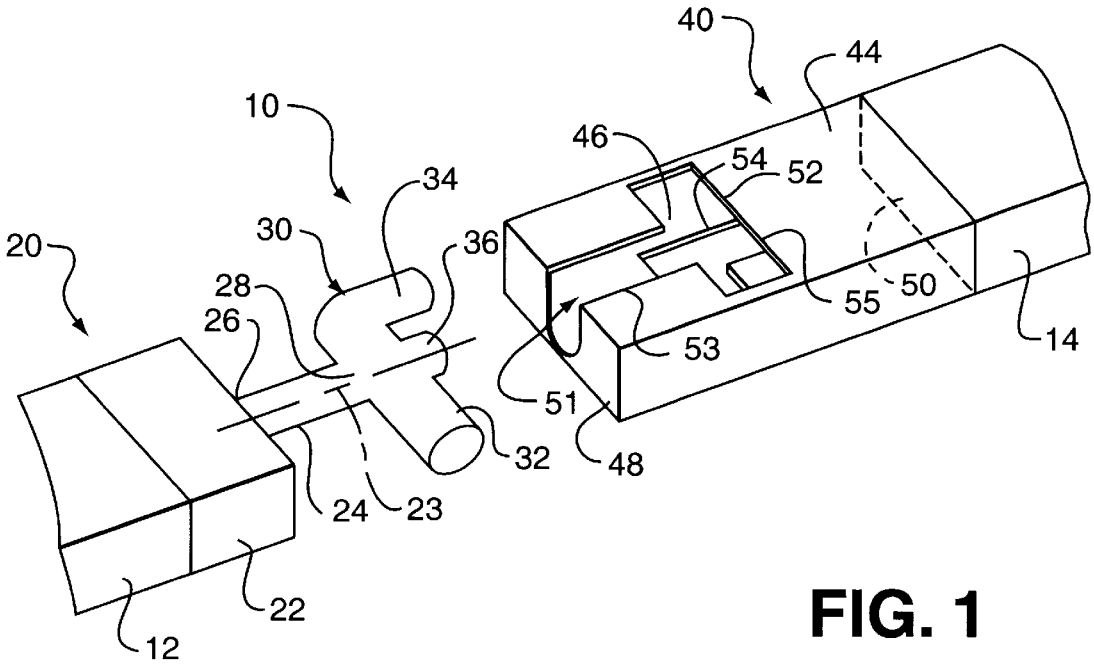
FIG. 1 is a perspective view of a jewelry clasp according to the preferred embodiment of the present invention wherein the clasp is illustrated in a disconnected configuration.
Figure 2:
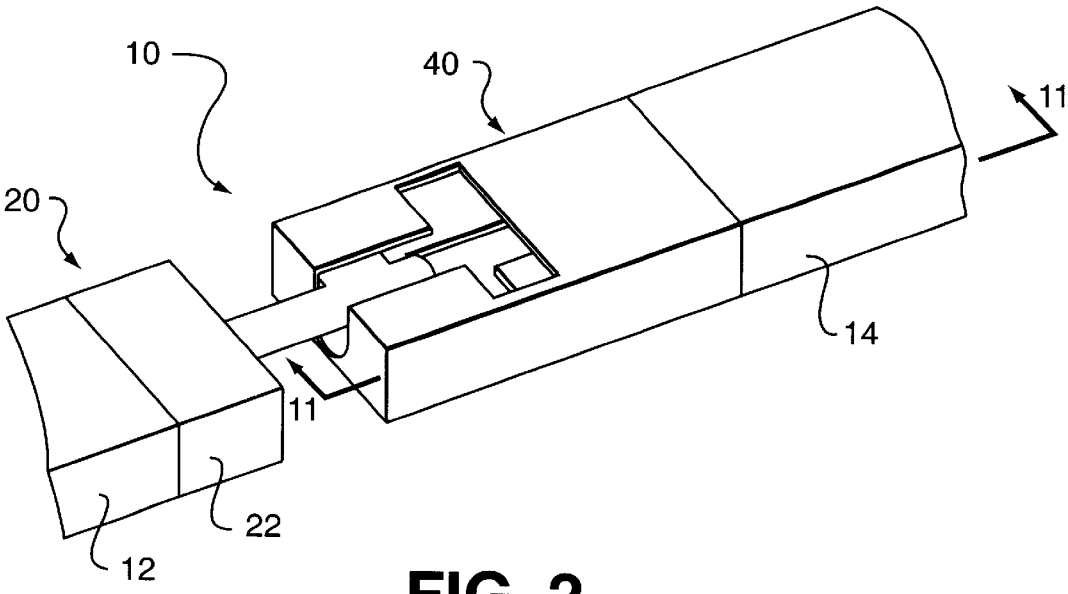
FIG. 2 is a perspective view of a jewelry clasp according to the preferred embodiment of the present invention wherein the clasp is illustrated in a connected configuration.

Turning now to the drawings and more particularly to FIG. 1, a jewelry clasp according to the present invention is illustrated generally at 10 and includes a connecting member 20 connected to a first strand end 12 for attachment to a receiving member 40 that is attached to a second strand end 14. FIG. 2 illustrates the clasp 10 with the connecting member 20 attached to receiving member 40.

The connecting member 20 is formed with a generally rectangular base 22, a generally cylindrical shaft 24 projecting outwardly therefrom and a key member 30 attached to the shaft 24, to which the strand end 12 is attached. It will be understood by those skilled in the art that the shape of the base 22 is not critical to the invention and will vary depending on the design of the strand to which it is attached. The shaft 24 includes a proximal end 26 attached to the base 22 and a distal end 28 extending laterally away from the base 22. The shaft 24 defines a shaft axis 29 that extends linearly along the center of the shaft 24 through the proximal and distal ends 26, 28 thereof. A key member 30 is formed generally in the shape of an "F" on the proximal end 26 of the shaft 24. This key member 30 includes a stem 32, an end cross-member 34 and a central cross-member 36, all being generally cylindrical and approximately the same diameter as the shaft 24. The two cross-members 34, 36 are disposed in substantially the same plane as the stem 32 and the central cross-member 36 is substantially collinear with the shaft 24. It will become clear to these skilled in the art that other key member 30 configurations are possible without departing from the spirit and scope of the present invention. As will be shown, the key member 30 must be configured in conjunction with the receiving member 40 so that when the connecting member 20 is rotated about the shaft axis 29 after partial insertion into the receiving member 40, the entire key member 30 is received and retained by the receiving member 40.

As previously stated, the jewelry clasp 10 includes a receiving member 40 connected to a second strand end 14. The receiving member 40 is formed as a generally rectangular block that has opposing, spaced apart first and second surfaces 44, 46 and opposing, spaced apart first and second end walls 48, 50. First and second side walls complete the block structure. It will be understood by those skilled in the art that non-rectangular shapes are also possible for the receiving member. These shapes may include prisms or generally circular or ovate cylinders. The receiving member 40 is formed with an internal receiving and retaining cavity 51 intermediate to the first and second surfaces 48, 50 and the first and second end walls 44, 46. The first and second surfaces 48, 50 are formed with first and second slots 52, 54, respectively that provide access to the receiving and retaining cavity 51. These slots 52, 54 are specifically configured and positioned to receive the F-shaped key member 30 by employing a sequence of movements that result in the secure retainment of the key member 30 within the receiving and retaining cavity 51.

Figure 3:
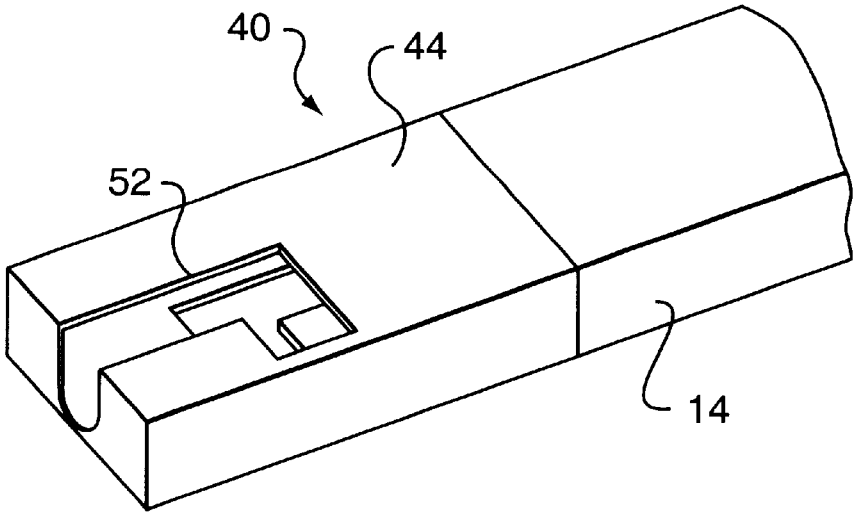
FIG. 3 is a top perspective view of the receiving member of a jewelry clasp according to the present invention.

The first slot 52 is preferably generally T-shaped with a column slot 53 and a top slot 55. The column slot 53 extends into the first end wall 48 and terminates adjacent the second surface 46. The first slot 52 is preferably T-shaped for ease of manufacturing. Alternatively, the first slot 52 may be generally L-shaped as shown in FIG. 3 without requiring alteration of the shape of the key member 30.

Figure 4:
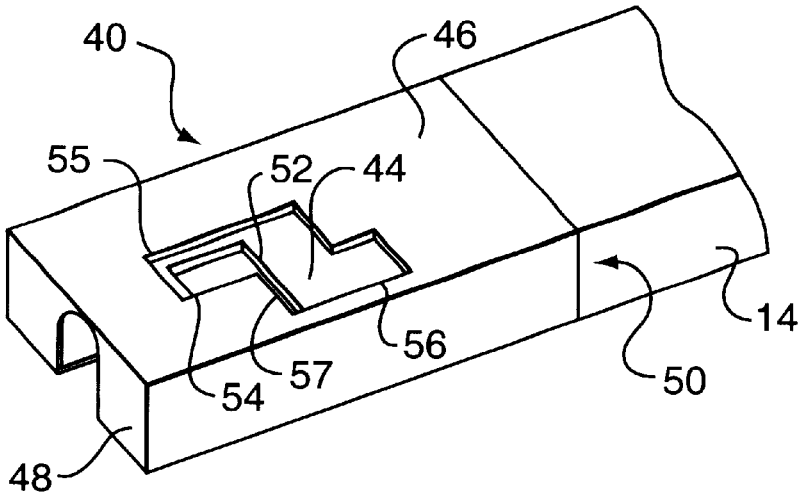
FIG. 4 is a bottom perspective view of the receiving member of the jewelry clasp illustrated in FIG. 1 showing the underside of the receiving member.

As shown in FIG. 4, the second slot 54 includes first and second parallel straight slots 55, 56 projecting in opposite directions from a cross-slot 57. The straight slots 55, 56 are oriented generally perpendicular to the cross-slot 57. The second slot 54 is positioned so that the first straight slot 55 is in registry with the column slot 53 of the first slot 52 and so that the cross-slot 57 is in registry with the top slot 55 of the first slot 52. As will be shown in greater detail hereinafter, this permits the partial passage of the key member 30 through the first and second slots 52, 54 when the connecting member 20 is in a first orientation and receipt of the entire key member 30 after a sequence of simple movements to a second orientation.

Figure 11:
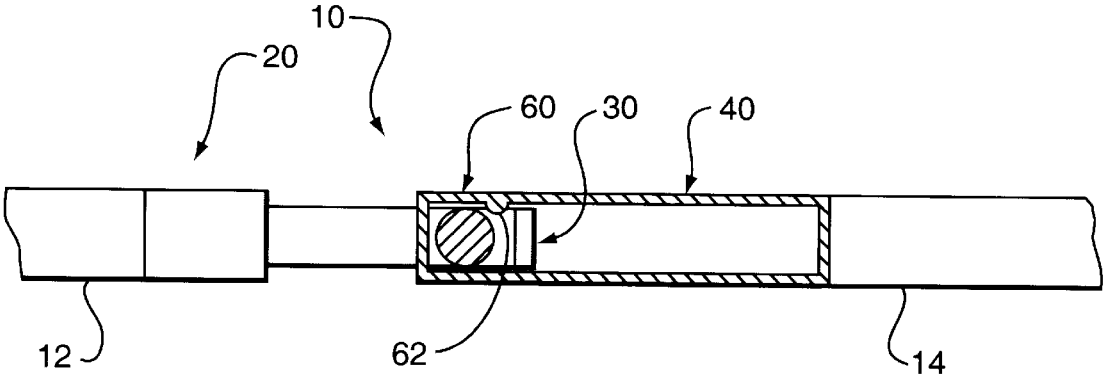
FIG. 11 is a cross-sectional view of the jewelry clasp illustrated in FIG. 2 and taken through lines 11—11 thereof.

As seen in FIG. 11, the clasp 10 includes a key retaining arrangement 60 to retain the key member in a retracted position in the form of two parallelly oriented tabs 62 formed on the inner surface of the receiving end retaining cavity 51. The key member 30 may be withdrawn past the tabs 62 to retain the clasp 10 in a locked condition.

When the key member 30 has been rotated into the receiving and retaining cavity 51 and is subsequently moved away from the second end wall 50, the key member 30 contacts the tabs 62, and may be moved therepast only by the application of additional force. When the key member 30 is in its fully retracted position between the tabs 62 and the first end wall 48 as shown in FIG. 11, movement of the key member 30 toward the second end wall 50 is impeded by the tabs 62. The increased force necessary to move the key member 30 past the tabs 62 thus renders inadvertent movement less likely. Additional tabs 62 may be used and tabs 62 may be disposed adjacent the first surface 44 as shown in FIG. 11, the second surface 46, or both. The tabs 62 may be formed in any suitable fashion including by indentation (dimpling) of the first and/or second surfaces 44, 46. It will be understood by those skilled in the art that other retaining mechanisms may also be used.

Figure 5:
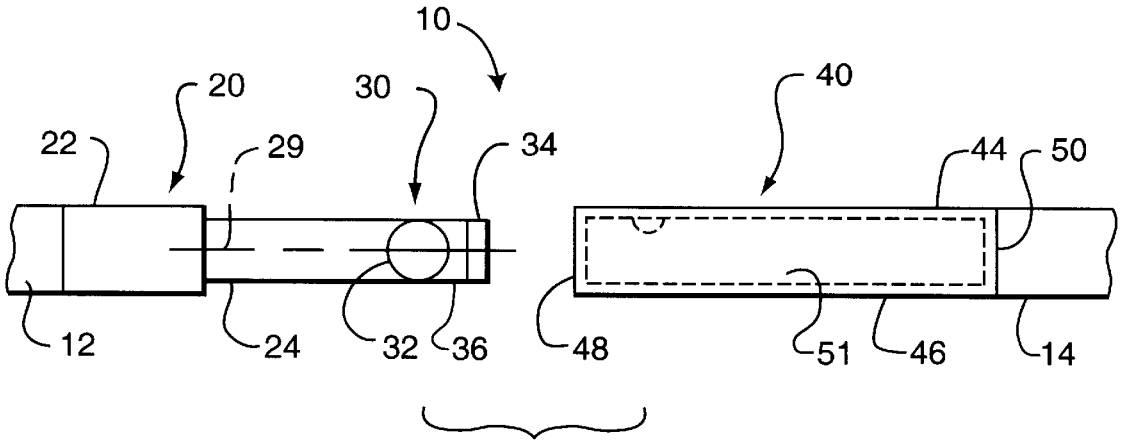
FIGS. 5–10 are side views of a jewelry clasp according to the present invention illustrating the sequence of movements used to join the key member and the receiving member of the clasp illustrated in FIG. 1, with the interior of the receiving member and portions of the key member disposed therein illustrated in broken lines for clarity.
Figure 6:
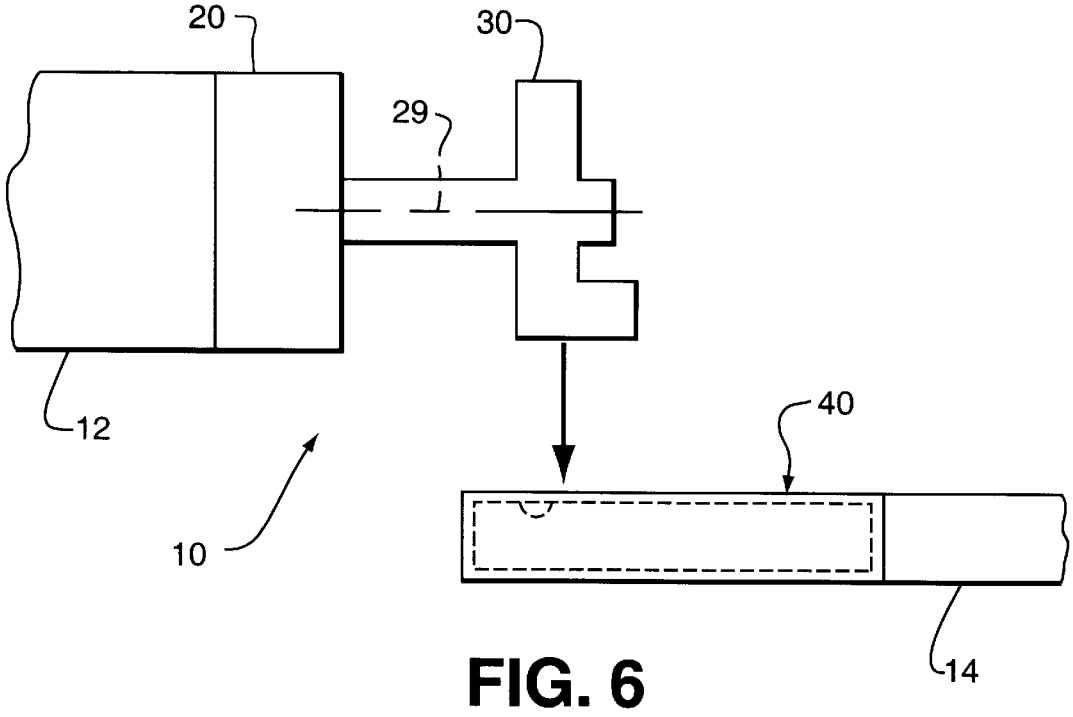

FIGS. 5–10 illustrate the sequence of movements used to secure a removable connection between connecting member 20 and receiving member 40. In these figures, the inner appearance of the receiving member 40 and portions of the key member 30 disposed therein are illustrated using broken lines for clarity. FIG. 5 illustrates an initial side view of both the connecting member 20 and the receiving member 40. The connection sequence is begun by placing the connecting member 20 into a first connection orientation by rotating the connecting member 20 ninety degrees (90°), or approximately one quarter turn, about the shaft axis 29 in a counter-clockwise direction as viewed from the proximal end 26 of the shaft 24. The resulting orientation is illustrated in FIG. 6.

Figure 7:
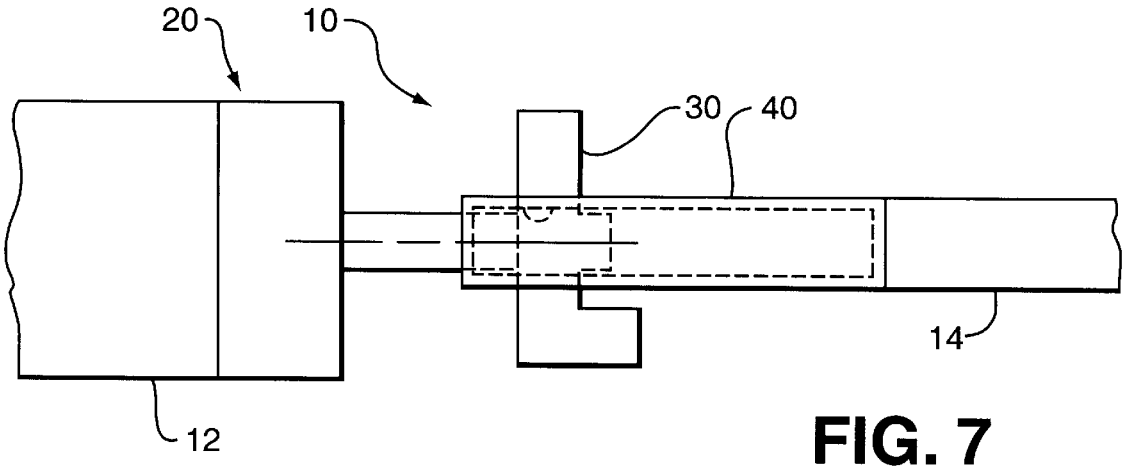
Figure 8:
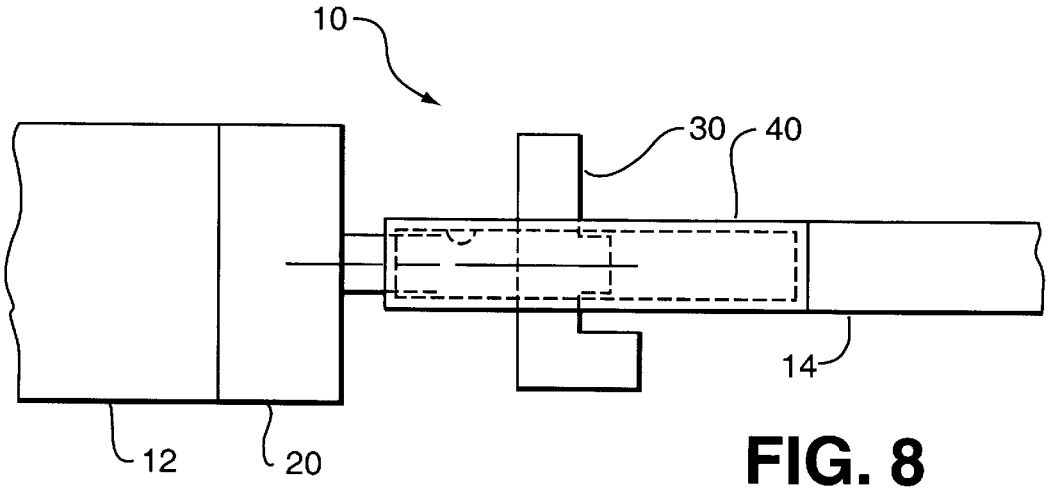
Figure 9:
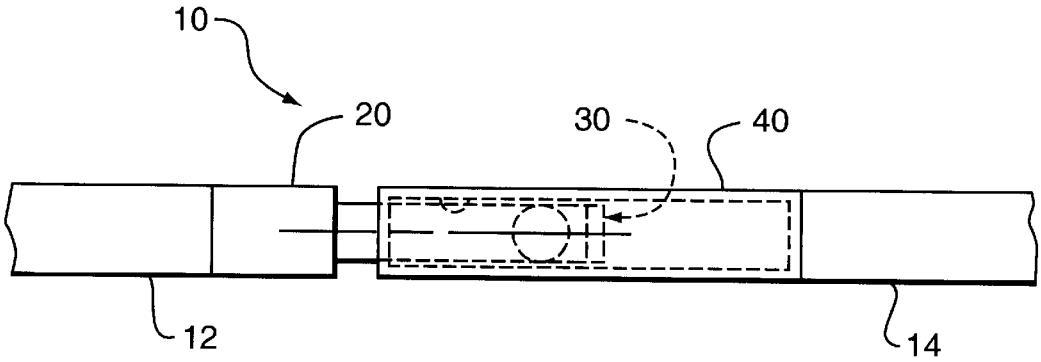

The connecting member 20 is then partially inserted into the receiving member 40 by inserting the end cross-member 34 of the key member 30 through the first and second slots 52, 54. The insertion stops when the shaft 24 contacts the second surface 46. This positions the central cross-member 36 within the receiving and retaining cavity 51 as shown in FIG. 7. Also as shown in FIG. 7, the shaft 24 extends through the first end wall 48 of the receiving member 40 via the extended portion of the first slot 52. In this position, the connecting member 20 is prevented from rotating by the edges of the first straight slot 55 and the column slot 53 of the T-shaped first slot 52. The connecting member 20 is then moved toward the second end wall 50 until the stem 32 of the key member 30 contacts the edges of the cross-slot 57 and the top slot 55 of the T-shaped first slot 52 as shown in FIG. 8. When the connecting member 20 is in this position, the configuration of the first and second slots 52, 54 permits rotation of the connecting member 20 in the clockwise direction. The connecting member 20 is then rotated clockwise ninety degrees around the shaft axis 29 to a second orientation. This causes the end cross-member 34 to rotate upwardly through the second straight slot 56 into the receiving and retaining cavity 51. At the same time, the end of the stem 32 opposite the top cross-member 34 rotates downwardly through the top slot 55 of the first slot 52 into the receiving and retaining cavity 51. The entire key member 30 is now positioned within the receiving and retaining cavity 51 as shown in FIG. 9. The connecting member 20 is then retracted away from the second end wall 50 until the stem 32 contacts the first end wall 48. In this final position, shown in FIG. 10, the connecting member 20 is substantially prevented from rotating and has only one translational degree of freedom.

Figure 10:
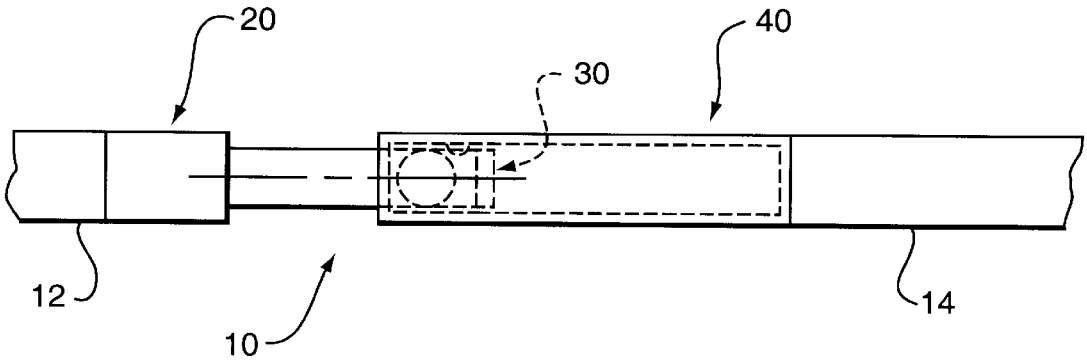

Once the jewelry clasp 10 is in its final closed position as shown in FIG. 10, the connecting member 20 may be freed from the receiving member 40 only through a reversal of the above sequence. Thus, separation can occur only through full translation of the connecting member 20 to the position shown in FIG. 9 followed by counterclockwise rotation, translation in the opposite direction from the first translation and removal in a direction perpendicular to this second translation. This sequence is readily accomplished when intended by the user, but is unlikely to occur inadvertently during normal use.

It will be understood by those skilled in the art that other configurations of the key member 30 and the receiving member slots 52, 54 may be used without departing from the spirit and scope of the present invention. The key member 30 and the slots 52, 54 are designed in conjunction with one another to facilitate a sequence of movements in which the connecting member 20 in a first orientation is partially inserted into the receiving member 40 and when rotated to a second orientation causes the key member 30 to be fully received by the receiving member 40. Any design combination suitable for facilitating this sequence may be used in the present invention.

The present invention provides a simple mechanism for connecting strand ends that is easy to use and provides a high degree of security against inadvertent release. Once fully engaged, the sequence of movements required to disengage the clasp members is easily accomplished but unlikely to occur unintentionally. It will be understood by those skilled in the art that the present invention, though particularly adaptable to jewelry applications, may be made virtually any size for joining various types of strands, including belts.

It will be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A clasp for releasably mating two strand ends, said clasp comprising:

a connecting member having a base and an elongate shaft projecting from said base with a proximal end and a distal end and defining a shaft axis, said connecting member further having a key member formed on said shaft with a predetermined configuration for rotation about said shaft axis;

a receiving member for receiving and retaining said key member, said receiving member having a first surface and a second surface in spaced opposition, said first surface having a first slot formed therein and said second surface having a second slot formed therein, said first and second slots being formed for receiving a first portion of said key member with said key member at a first orientation with respect to said receiving member and said first slot being formed for receiving a second portion of said key member when said key member is rotated about said shaft axis to a second orientation with respect to said receiving member, whereby said key member is retained by said receiving member.

2. A clasp according to claim 1 wherein said receiving member is formed as a generally rectangular block defining said first surface and said second surface and further defining a first end wall and a second end wall in spaced opposition, said receiving member having a receiving and retaining cavity formed therein, said first and second slots being in communication with said receiving and retaining cavity for receiving said first portion of said key member at said first orientation and for receiving said second portion of said key member when said key member is rotated to said second orientation.

3. A clasp according to claim 2 wherein said first slot extends into said first end wall from said first surface.

4. A clasp according to claim 2 wherein said first slot is generally T-shaped and said second slot includes two parallelly oriented straight slots projecting oppositely away from a cross-slot oriented generally perpendicular to said straight slots.

5. A clasp according to claim 2 wherein said first slot is generally L-shaped and said second slot includes two parallelly oriented straight slots projecting oppositely away from a cross-slot oriented generally perpendicular to said straight slots.

6. A clasp according to claim 2 wherein said slots formed in said receiving member are further configured and positioned for said key member to be retracted laterally away from said second end wall after having been first partially inserted through said first and second slots, moved toward said second end wall, and then rotated ninety degrees about said shaft axis for receipt of said key member by said receiving member, thereby substantially enclosing said key member within said receiving and retaining cavity.

7. A clasp according to claim 6 wherein said receiving member includes means for selectively, removably retaining said key member in a retracted position after rotation.

8. A clasp according to claim 7 wherein said means for selectively, removably retaining said key member in a retracted position after rotation includes at least one tab projecting into said receiving and retaining cavity for contact with said key member to selectively impede movement of said key member by requiring an increased force be applied to retract or release said key member.

9. A clasp according to claim 1 wherein said key member is generally F-shaped and includes a stem, an end cross-member and a central cross-member.

10. A clasp according to claim 9 wherein said end cross-member and said central cross-member are disposed substantially coplanar to said stem, and project perpendicularly away therefrom, with said end cross-member projecting from a free end of said stem and with said central cross-member being substantially collinear with said shaft.

11. A clasp for releasably mating two strand ends, said clasp comprising:

a connecting member having a base and an elongate shaft projecting from said base with a proximal end and a distal end and defining a shaft axis, said connecting member further having a generally F-shaped key member formed on said shaft, said F-shaped key member having a stem, an end cross-member and a central cross-member;

a receiving member for receiving and retaining said key member, said receiving member having slots formed therein for receiving a first portion of said key member with said key member at a first orientation with respect to said receiving member and for receiving a second portion of said key member when said key member is rotated about said shaft axis to a second orientation with respect to said receiving member, whereby said key member is retained by said receiving member.

12. A clasp according to claim 11 wherein said receiving member is formed as a generally rectangular block having a first surface and a second surface in spaced opposition and a first end wall and a second end wall in spaced opposition, said receiving member having a receiving and retaining cavity formed therein, said receiving member slots including a first slot formed in said first surface, and a second slot formed in said second surface said first and second slots being in communication with said receiving and retaining cavity for receiving said first portion of said key member at said first orientation and for receiving said second portion of said key member when said key member is rotated to said second orientation.

13. A clasp according to claim 12 wherein said first slot extends into said first end wall from said first surface.

14. A clasp according to claim 12 wherein said first slot is generally T-shaped and said second slot includes two parallelly oriented straight slots projecting oppositely away from a cross-slot oriented generally perpendicular to said straight slots.

15. A clasp according to claim 12 wherein said first slot is generally L-shaped and said second slot includes two parallelly oriented straight slots projecting oppositely away from a cross-slot oriented generally perpendicular to said straight slots.

16. A clasp according to claim 12 wherein said slots formed in said receiving member are further configured and positioned for said key member to be retracted laterally away from said second end wall after having been first partially inserted through said first and second slots, moved toward said second end wall, and then rotated ninety degrees about said shaft axis for receipt of said key member by said receiving member, including receipt of said end cross-member by said second slot, thereby substantially enclosing said key member within said receiving and retaining cavity.

17. A clasp according to claim 16 wherein said receiving member includes means for selectively, removably retaining said key member in a retracted position after rotation.

18. A clasp according to claim 17 wherein said means for selectively, removably retaining said key member in a retracted position after rotation includes at least one tab projecting into said receiving and retaining cavity for contact with said key member to selectively impede movement of said key member by requiring an increased force be applied to retract or release said key member.

19. A clasp according to claim 11 wherein said end cross-member and said central cross-member are disposed substantially coplanar to said stem, and project perpendicularly away therefrom, with said end cross-member projecting from a free end of said stem and with said central cross-member being substantially collinear with said shaft.

20. A clasp for releasably mating two strand ends, said clasp comprising:

a connecting member having a base, an elongate shaft projecting from said base with a proximal end and a distal end and defining a shaft axis, said connecting member further having a generally F-shaped key member, said F-shaped key member having a stem, an end cross-member and a central cross-member, said key member being connected to said distal end of said shaft, and said end cross-member and said central cross-member being disposed substantially coplanar to said stem and projecting perpendicularly away therefrom, with said end cross-member projecting from a free end of said stem and with said central cross-member being substantially collinear with said shaft;

a receiving member for receiving and retaining said key member, said receiving member formed as a generally rectangular block having a first surface and a second surface in spaced opposition and a first end wall and a second end wall in spaced opposition, said receiving member having a receiving and retaining cavity formed therein, said first surface having a first generally T-shaped slot formed therein, and said second surface having a second slot formed therein, said second slot including two parallelly oriented straight slots projecting oppositely away from a cross slot oriented generally perpendicularly to said straight slots, said first and second slots being in communication with said receiving and retaining cavity for receiving a first portion of said key member with said key member at a first orientation with respect to said receiving member and for receiving a second portion of said key member when said key member is rotated about said shaft axis to a second orientation with respect to said receiving member, said first and second slots being configured and positioned so that said key member may be first partially inserted through said first and second slots, then moved toward said second end wall so that said central cross-member is completely enclosed within said receiving member, then rotated ninety degrees about said shaft axis for receipt of said key member by said receiving member including receipt of said end cross-member by said second slot, and then retracted laterally away from said second end wall to a retracted position, thereby substantially enclosing said key member; and means attached to said receiving member for selectively, removably retaining said key member in said retracted position.

21. A clasp according to claim 20 wherein said means for selectively, removably retaining said key member in a retracted position after rotation includes at least one tab projecting into said receiving and retaining cavity for contact with said key member to selectively impede movement of said key member by requiring an increased force be applied to retract or release said key member.

22. A method for releasably mating two strand ends, said method comprising the following steps:

providing a connecting member attached to a first strand end, said connecting member having a base and an elongate shaft projecting from said base with a proximal end and a distal end, said connecting member further having a key member with a predetermined configuration;

providing a receiving member attached to a second strand end for receiving and retaining said key member, said receiving member being formed as a generally rectangular block having a first surface and a second surface in spaced opposition and a first end wall and a second end wall in spaced opposition, said receiving member having a receiving and retaining cavity formed therein, said first surface having a first slot formed therein, and said second surface having a second slot formed therein, said first and second slots being in communication with said receiving and retaining cavity for receiving a first portion of said key member with said key member at a first orientation with respect to said receiving member and for receiving a second portion of said key member when said key member is rotated about said shaft axis to a second orientation with respect to said receiving member;

inserting said key member partially through said first and second slots;

moving said key member toward said second end wall; and rotating said key member approximately ninety degrees around said shaft axis for receipt of said key member by said receiving member.

23. A method for releasably mating two strand ends according to claim 22 and further comprising the step of:

retracting said key member laterally away from said second end wall after said rotation step, thereby substantially enclosing said key member in said receiving and retaining cavity.

* * * * *